United States Patent [19]

Vallieres et al.

[11] Patent Number: 4,621,578

[45] Date of Patent: Nov. 11, 1986

[54] PYROTECHNIC INITIATOR USING A COAXIAL CONNECTOR

[75] Inventors: Yves Vallieres, Vert le Petit; Georges Granier, Viry-Chatillon, both of France

[73] Assignee: Societe Nationale des Poudres et Explosifs, Paris, France

[21] Appl. No.: 681,011

[22] Filed: Dec. 13, 1984

[30] Foreign Application Priority Data

Dec. 28, 1983 [FR] France ..... 83 20906

[51] Int. Cl.[4] ..... F42C 19/12

[52] U.S. Cl. ..... 102/202.9; 102/202.5

[58] Field of Search ..... 102/202.9, 202.5

[56] References Cited

U.S. PATENT DOCUMENTS

| | | | |
|---|---|---|---|
| 2,386,211 | 10/1945 | Grant, Jr. . | |
| 2,920,569 | 1/1960 | Menke et al. | 102/202.9 |
| 3,059,576 | 10/1962 | Haefner . | |
| 3,099,957 | 8/1963 | Seavey . | |
| 3,196,041 | 7/1965 | McNally et al. . | |
| 3,291,046 | 12/1966 | Dahl . | |
| 3,971,320 | 7/1976 | Lee | 102/202.9 |
| 4,267,567 | 5/1981 | Nygaard et al. | 102/202.5 |
| 4,332,098 | 6/1982 | Estenevy . | |

FOREIGN PATENT DOCUMENTS

| | | |
|---|---|---|
| 1204477 | 1/1960 | France . |
| 1426002 | 12/1965 | France . |
| 2216545 | 8/1974 | France . |
| 1165053 | 9/1969 | United Kingdom . |

*Primary Examiner*—Charles T. Jordan

*Attorney, Agent, or Firm*—Bucknam and Archer

[57] ABSTRACT

Pyrotechnic initiators tripped by an electric current passing through a resistive element. These initiators can either be an inflammator, an igniter or a detonator.

The pyrotechnic initiator with coaxial structure includes at least one filament (39) connected to the central conductor (34) and to peripheral conductor (35). To improve operating safety while simplifying the structure of the initiator, it is fitted with a standard coaxial connector (33), the end of which, intended for connection of the filament, is modified. The electrical insulation means, between the two conductors (34) and (35) and the electrical insulation means between the peripheral conductor (35) and the outside of the inflammator, include a common dielectric mass (40).

16 Claims, 5 Drawing Figures

PYROTECHNIC INITIATOR USING A COAXIAL CONNECTOR

Figure 1:
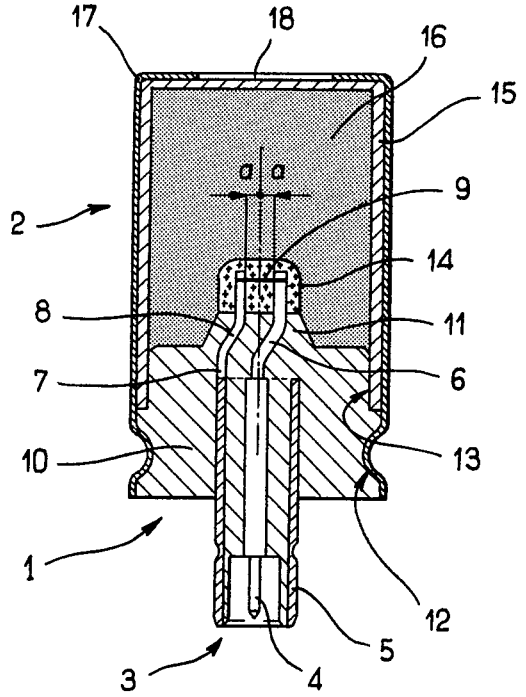

This invention pertains to pyrotechnic initiators tripped by an electric current passing through a resistive element which can be brought very quickly to the self-reaction temperature of the sensitive pyrotechnic compound surrounding this resistive element. According to the most commonly-used terminology, the designation "pyrotechnic initiator" encompasses both inflammators that include only the pyrotechnic compound to make contact with the resistive element and igniters and detonators for which initiation of the pyrotechnic compound in contact with the resistive element entails either ignition of an ignition powder which burns, or ignition of a primary explosive which detonates.

Pyrotechnic initiators with a coaxial structure are known and their main advantage is that they do not require any angular directioning, unlike two-wire pyrotechnic initiators.

Two types of initiator currently exist, depending on the pattern of the resistive element. The first type of initiator uses a resistive filament often connected to the central conductor and to the peripheral conductor by soldering and patent FR No. 2 216 545 pertains to such a type of initiator where bridging wire (14) is soldered to the metal connecting pin (13) and to the external metal jacket (12). The second type of initiator uses a resistive layer, generally crown-shaped, which can be formed through vacuum evaporation and patent FR No. 2 388 246 pertains to such a type of initiator. Here the resistive metal layer is applied to surface (12) which connects conducting sleeve (1) to central bar (2), coaxial with the sleeve, and sensitive pyrotechnic compound (11) contained in capsule (10) makes contact with the resistive metal layer. This patent FR No. 2 388 246 pertains to an electric ignition device and it must be noted that, though the upper ends of the sleeve, the central bar and insulating body (4) form a coaxial connection, the lower end of the sleeve does not match any standard coaxial connector and requires the use of another insulating body (3). This sleeve is in turn insulated from the frame (13) by another electrically-insulating body (14), for example made of glass.

The present invention pertains solely to pyrotechnic initiators with coaxial structure including at least one filament connected to the central conductor and to the peripheral conductor. Its main object is to improve the operating safety of the initiators, even after extended storage, and this is achieved by simplifying the initiator structure.

The present invention is characterized in that the inflammator consists of a standard coaxial connector, the end of which (intended for connection to the resistive filament) is modified, and in that the electrical insulation means between the two conductors and the electrical insulation means between the peripheral conductor and the outside of the inflammator, include a common dielectric mass.

In particular, the peripheral conductor of the standard coaxial connector includes at least one aperture situated at the level of the dielectric mass. For example, this aperture can be a drilled hole or a slot or, in particular, a slot directed axially and reaching up to the end of this peripheral conductor. Preferentially, the aperture defines at least a peripheral tab intended for connection of the resistive filament.

According to the first embodiment, the peripheral conductor has the advantage of including two lateral grooves providing two peripheral tabs, diametrically opposed to one another. A rectilinear resistive filament is attached to the tabs and also to the end of the central conductor. However, following a second embodiment, the peripheral conductor is fitted with a wide lateral groove providing only one peripheral tab.

According to a particular embodiment, the tabs of the peripheral conductor are bent so that the free length of the resistive filament matches the desired resistance. When the inflammator includes only one peripheral tab, bending of this tab and of the central conductor enables the ends of these two conductors to be positioned symmetrically with respect to the centreline of the standard coaxial connector. It is also possible to increase the free length of the resistive filament and to have the ends of both conductors not situated in a same plane, perpendicular to the centreline of the standard coaxial connector. Here, the difference in length between the two conductors allows the resistive filament to be attached in a slanted position.

An advantage is that the common dielectric mass is continuous. This dielectric mass is obtained through a single pressure-molding operation which enables the peripheral conductor to be insulated from both the central conductor and the outside of the inflammator. According to a specific construction form, the dielectric mass includes central bossing on the face through which the end-zones of the two conductors pass. The contour of this bossing approximately corresponds to the contour of the sensitive pyrotechnic compound which surrounds the filament and this compound is fastened to this bossing.

The common dielectric mass can include an outer metal insert which does not come into contact with the peripheral conductor. A crimping groove can be provided on the outer surface of the inflammator, in the common dielectric mass as well as in the metal insert. This crimping groove, particularly intended for fastening a jacket containing an ignition powder or an explosive, can be supplemented by a threading particularly intended for fastening the pyrotechnic initiator to a support. It is recommended that a cap containing an ignition powder be made out of a dielectric material such as plastic and fits on a peripheral, cylindrical surface of the common dielectric mass. This cap is topped by a cylindrical metal jacket crimped on the base of the inflammator. There is a wide aperture at the bottom of the inflammator.

The advantages derived from this invention mainly consist in that the modification of the end-zone of a standard coaxial connector—in particular by machining—does not entail any risk of electrical or mechanical discontinuity between the coaxial connecting zone and the end receiving the resistive element. The elimination of this risk contributes to obtaining a high-reliability initiator. Reliability is also improved by execution of a fully compact initiator, without any internal cavity, since a continuous, common dielectric mass insulates the conductors from one another and insulates the peripheral conductor from the outside of the inflammator. This common dielectric mass can even extend into the coaxial connnector and replace the insulant of this standard connector. This common dielectric mass can always be formed by a simple injection-molding operation. This eliminates all risks of discontinuity of the insulation and so produces a high-reliability and low-cost initiator. When the pyrotechnic initiator, of the invention, is an igniter and thus consists of an inflammator and a jacket containing an ignition powder, manufacturing safety and operating reliability can be improved simultaneously through the use of a plastic cap. This houses the ignition powder and is covered with a metal jacket with a wide aperture at its bottom. The aperture helps to improve the directivity of the igniter.

Figure 2:
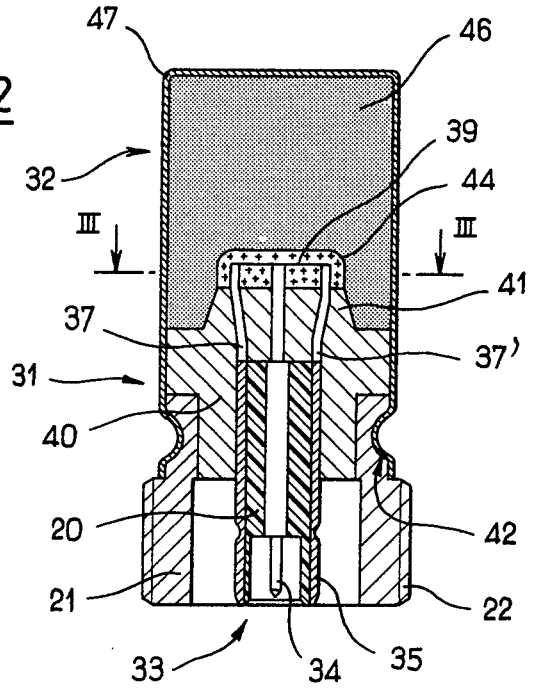
Figure 3:
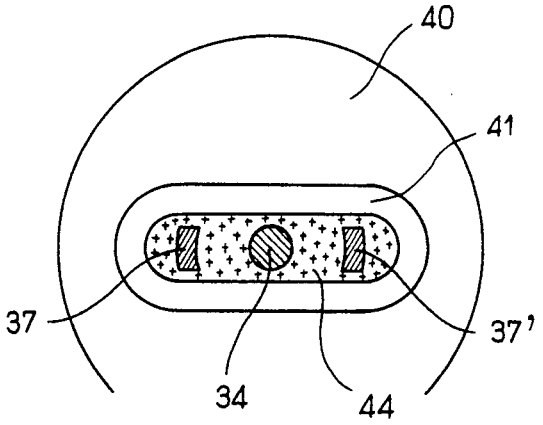
Figure 4:
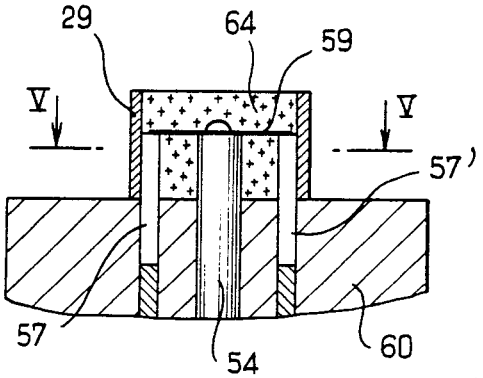
Figure 5:
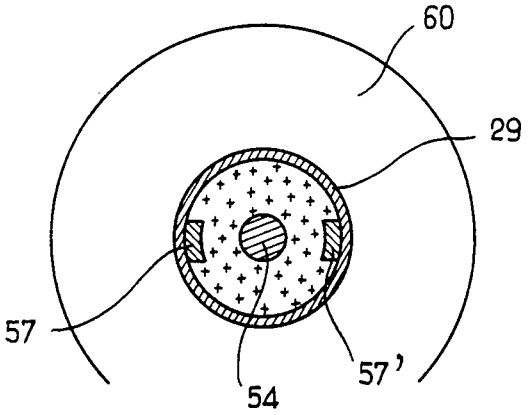

The invention is detailed further hereinafter by a drawing showing several specific execution modes in which:

FIG. 1 is an axial sectional view of a first pyrotechnic initiator constituting a simple igniter, FIG. 2 is an axial sectional view showing a second pyrotechnic initiator constituting a dual-safety igniter, FIG. 3 is a part sectional view, along transversal plane III—III, of the initiator inflammator shown in FIG. (2), FIG. 4 is a part axial sectional view showing the end-zone of another inflammator execution mode, FIG. 5 is a part sectional view, along transversal plane V—V, of the end-zone of the inflammator shown in FIG. 4.

According to FIG. 1, the pyrotechnic initiator is an igniter which essentially consists of an inflammator (1) and an ignition assembly (2). The inflammator is fitted with a coaxial connector (3). The central conductor (4) and peripheral conductor (5) of a coaxial connector (3) are made from standard elements marketed by coaxial connector manufacturers and positioned with respect to one another so as to form a standard coaxial connector. The end-zone of the central conductor as supplied is cut off and includes a dual bend (6) so that the distal part is parallel to the centreline of this conductor and is at a distance a away from this centreline. The end-zone of the peripheral conductor as supplied is routed to provide only one peripheral tab (7) and this tab is fitted with a dual bend (8) so that the distal part is parallel to the centreline of this conductor and is at a distance a away from this centreline. Thus, the associated bends of the two conductors fasten resistive filament (9) virtually in the centre and set the free length of this filament according to its linear resistivity and to the desired inflammator resistance. A high value for distance a leads to dual bends of widely different amplitude for both conductors and to a higher resistance for a filament with a given resistivity. The common dielectric mass (10) is continuous and homogenous. It is formed through a single operation in a pressure-molding mold where the two conductors have been positioned. This dielectric mass includes central bossing in the shape of a truncated cone (11) placed on the face through which pass the end-zones of the two conductors and an outer peripheral groove (12) as well as a peripheral cylindrical bearing surface (13). After the over-molding and filament fastening operation, the inflammator is completed by placing sensitive pyrotechnic compound (14) around the end-zone of the conductors that protrude from bossing (11). Due to the small dimensions of the inflammator and igniter in FIG. 1—the outer diameter of the coaxial cable is 3.71 mm, international standard—this compound is positioned by dipping and after drying forms the ignition bead. In the example described, the standard conductors were purchased from RADIALL Co. and common dielectric mass (10) is polyamide. The filament resistance is 3000 ohm/m and it is made from a nickel-chromium-iron alloy whereas the ignition bead is based on potassium chlorate, lead sulfocyanide and zirconiumm hydride.

The ignition assembly (2) fastened to the inflammator includes a cylindrical cap (15), made of "Rilsan" (Polyamide 11) for example, which mates with the peripheral, cylindrical bearing surface (13) of the inflammator and is filled with ignition powder (16) based on zirconium, barium chromate and ammonium perchlorate. The thickness of the bottom of this cap is less than the thickness of its shell and it is covered by a nickel-plated brass plate (17) crimped onto outer groove (12) machined in the inflammator base and it has a circular aperture (18).

According to FIGS. 2 and 3, the second pyrotechnic initiator is also an igniter and thus also consists of an inflammator (31) and an ignition assembly (32). The inflammator is fitted with a standard coaxial connector (33). The end-zones of the peripheral conductor (35) and internal insulant (20) have been machined so as to provide two peripheral tabs (37) and (37'). These are bent symmetrically outwards with respect to an axial plane. In this case, common dielectric mass (40) is in contact with the internal insulant (20) of the coaxial connector. This dielectric and this insulant must be compatible so as not to generate any insulation discontinuity. The common dielectric mass is always continuous and homogenous and, as in the case of FIG. (1), it can be formed through a single operation in a pressure-mold in which the modified coaxial connector and metal insert (21) are positioned. Common dielectric mass (40) also includes a central bossing (41) on the face, through which pass the end-zones of the two conductors. However this bossing includes two oblique sides, parallel to filament (39) and is connected to the ends of two half-cones.

Common dielectric mass (40) also ensures full insulation between outer metal insert (21) and peripheral conductor (35). This insert, which can be made of brass, is fitted with a crimping groove (42) and with an outer threading (22). The central bore has a size that enables the positioning of standard coaxial connectors. Filament (39) is soldered to each end of the two peripheral tabs (37) and (37') and to the cut-off end of the central conductor (34), thus making-up two firing circuits for sensitive pyrotechnic compound (44) which coats both this filament and the three end-zones of the conductors of the coaxial connector. The shape of central bossing (41) and the layout of the end-zones of the conductors enable the sensitive pyrotechnic compound to be placed by dipping, the ignition bead thus formed having an elongated shape. Ignition powder (46) is contained in nickel-plated brass jacket (47) which is directly crimped onto outer groove (42) machined in metal insert (21), common dielectric mass (40) being capable of ensuring full sealing.

FIGS. 4 and 5 show a variant of the end-zone of an inflammator. This is also suitable for a peripheral coaxial conductor with two tabs (57) and (57') as shown, as well as for a peripheral coaxial conductor fitted with only one tab. According to these figures, the width of the tabs is slightly greater than the diameter of the cut-off end-zone of central conductor (54) and a cylindrical shell (29), made of polyamide for instance, forms a cup around the three ends of the conductors. The inner diameter of this shell is slightly smaller than the outer diameter of the standard coaxial connector and it is held in place by bonding to the two tabs. Such a cup is used as a receptacle when casting sensitive pyrotechnic compound (64) which fully coats filament (59). This cup can be formed directly by common dielectric mass (60), in particular when the inner diameter of this cup is larger than the outer diameter of the coaxial connector.

We claim:

1. A pyrotechnic initiator comprising an igniter (1,31), said igniter comprising a coaxial connector (3,33), said coaxial connector comprising a central electric conductor (4,34), a peripheral electric conductor (5,35) coaxial with said central conductor, said igniter having an outer surface, said coaxial connector having a modified end zone, electric insulating means positioned between the central electric conductor and the peripheral electric conductor and positioned between said peripheral conductor and said outer surface of said igniter, said electric insulating means comprising a common dielectric mass (10,40), at least one resistance element (9,39) connected to said central electric conductor and to said peripheral conductor, said end zone of said coaxial connector being connected to said resistance element a pyrotechnic substance surrounding said resistance element and said end zone of said coaxial connector.

2. The pyrotechnic initiator according to claim 1, wherein said peripheral conductor includes at least one aperture at the level of said dielectric mass.

3. The pyrotechnic initiator according to claim 2, wherein said aperture reaches the upper end of the peripheral conductor and defines at least one peripheral tab (7–37), said tab being connected to said resistance element.

4. The pyrotechnic initiator, according to claim 3, wherein said peripheral conductor is provided with two lateral grooves providing two diametrically opposed peripheral tabs (37) and (37').

5. The pyrotechnic initiator according to claim 3, wherein said peripheral conductor is provided with one lateral groove providing only one peripheral tab (7).

6. The pyrotechnic initiator according to claim 4, wherein said tabs of said peripheral conductor (7–37) are bent.

7. The pyrotechnic initiator according to claim 6, wherein said central electric conductor has an end zone and said end zone is bent.

8. The pyrotechnic initiator according to claim 5, wherein said tab of said peripheral conductor has an end zone, said central electric conductor has an end zone and both said end zones are symmetrical with respect to the centreline of said coaxial connector (3).

9. The pyrotechnic initiator according to claim 1, wherein said common dielectic mass (10–40) is continuous, and is obtained by a single pressure-molding operation.

10. The pyrotechnic initiator according to claim 1, wherein said dielectric mass includes a central bossing (11,41), said electric central conductor and said peripheral conductor have end zones, said end zones pass through said bossing.

11. The pyrotechnic initiator according to claim 1, wherein said common dielectric mass includes an outer metal insert (21).

12. The pyrotechnic initiator according to claim 1, wherein said outer surface of said igniter includes a crimping groove (12–42).

13. The pyrotechnic initiator according to claim 11, wherein said outer metal insert includes both a crimping groove and a threading (22).

14. The pyrotechnic initiator according to claim 9, wherein said common dielectric mass includes a cylindrical, peripheral bearing surface (13), said initiator comprises a cap (15), said cap contains an ignition powder (16), and said cap mates with said bearing surface.

15. The pyrotechnic initiator according to claim 14, wherein said cap (15) is made of dielectric material.

16. The pyrotechnic initiator according to claim 14, wherein said cap (15) has a cylindrical metal jacket (17) at the top thereof, said igniter has an outer groove (12) at the base thereof, said jacket is crimped onto said outer groove, said cap has a circular opening (18).

* * * * *